US006318029B1

(12) United States Patent
Huppunen

(10) Patent No.: US 6,318,029 B1
(45) Date of Patent: Nov. 20, 2001

(54) HOUSE FRAMING AND APPARATUS FOR MANUFACTURING SUCH FRAMING

(76) Inventor: Erkki Huppunen, Hovitie 9, FIN-01380 Vantaa (FI)

( * ) Notice: Subject to any disclaimer, the term of this patent is extended or adjusted under 35 U.S.C. 154(b) by 0 days.

(21) Appl. No.: 09/423,140

(22) PCT Filed: May 6, 1998

(86) PCT No.: PCT/FI98/00385

§ 371 Date: Nov. 8, 1999

§ 102(e) Date: Nov. 8, 1999

(87) PCT Pub. No.: WO98/50645

PCT Pub. Date: Nov. 12, 1998

(30) Foreign Application Priority Data

May 6, 1997 (FI) ..... 971928

(51) Int. Cl.[7] ..... E04B 1/00

(52) U.S. Cl. ..... 52/105; 52/653.1; 52/656.9; 52/729.1; 52/729.4; 144/3.1; 144/4.8; 144/367; 144/368

(58) Field of Search ..... 52/105, 653.1, 52/656.9, 729.1, 729.4, 656.1; 403/403, 382, 230, 231, 244; 144/4.8, 3.1, 367, 368, 136.1, 356, 357

(56) References Cited

U.S. PATENT DOCUMENTS

| | | | | |
|---|---|---|---|---|
| 2,495,966 | * | 1/1950 | Haines | 52/92.1 |
| 2,880,470 | * | 4/1959 | Pickersgill | 52/92.1 |
| 2,902,733 | * | 9/1959 | Justus | 52/92.1 |
| 3,082,492 | * | 3/1963 | Grubb | 52/92.1 |
| 3,206,903 | * | 9/1965 | Johnson | 52/92.1 |
| 3,674,064 | * | 7/1972 | McRae | 144/356 |
| 4,413,459 | * | 11/1983 | Lambuth | 52/729 |
| 4,715,162 | * | 12/1987 | Brightwell | 52/729 |
| 4,894,963 | * | 1/1990 | Campbell | 52/90 |
| 5,170,600 | * | 12/1992 | Terrell | 52/90 |
| 5,323,584 | * | 6/1994 | Scarlett | 52/729 |
| 5,375,381 | * | 12/1994 | Park et al. | 52/92.1 |
| 5,562,134 | * | 10/1996 | Sato | 144/356 |
| 6,012,262 | * | 1/2000 | Irving | 52/729.4 |

FOREIGN PATENT DOCUMENTS

| | | | | |
|---|---|---|---|---|
| 4416075 | | 11/1994 | (DE) . | |
| 4447080 | | 7/1996 | (DE) . | |
| 3512306 A1 | * | 10/1986 | (DE) | 52/90 |
| 86/02398 | | 4/1986 | (WO) . | |

* cited by examiner

*Primary Examiner*—Beth A. Stephan
*Assistant Examiner*—Dennis L. Dorsey
(74) *Attorney, Agent, or Firm*—Rosenman & Colin, LLP

(57) ABSTRACT

Wooden framework building system consisting of semi-finished industrial product formed of glued boards. The construction according to the invention is made from only two bearing elements forming sill (1), purlin (2), ledge (4) and post (3). The cross-sections of the two bearing elements have each one side of the same size. The sizes for each particular case are determined by the requirements of the projects and plans, the statistical and physical aspects of the construction. To provide for an accurate, undismountable and resistant connection of the construction elements two dowels (9) are used per assembly. The lengths of the construction elements are determined from the module selected for the horizontal, respectively vertical elements.

10 Claims, 12 Drawing Sheets

HOUSE FRAMING AND APPARATUS FOR MANUFACTURING SUCH FRAMING

FIELD OF THE INVENTION

The present invention relates to a wall frame system of framework construction for a building, in which the frame components of the wall frame are joined together via splayed notch joints and in which each frame component is provided with markings to facilitate installation.

BACKGROUND OF THE INVENTION

In prior art, roughed-out framing systems for wooden buildings are known in which, to facilitate installation, the various parts of the framework are prefabricated prior to being transported to the building site. DE specification 35 12 306 A1 presents a lattice-like frame structure in which the vertical components of each wall frame are joined to a top or bottom stringer via a mortise and tenon joint in which both the horizontal top and bottom stringers and the vertical component are provided with round holes into which separate round tenons are fitted. In joints connecting adjacent wall frames at right angles to each other, mortise and tenon joints are used in the top stringers in which e.g. a central mortise of a rectangular cross-section is made in the top side of the top stringer and the end of the wall component to be joined with it is then fitted into this mortise. The task of joining individual components together can be facilitated by providing them with markings allowing the right components to be joined to each other. This prior-art solution has the drawback of being complex and slow. Drilling small holes for the mortise and tenon joints at exactly the correct positions requires great precision and plenty of time. U.S. Pat. No. 5,170,600 presents a prefabricated housing addition in which dovetail joints are used to connect wall frame components to each other and also to other parts of the wall frame. A drawback with this solution is difficult installation, because adapting the dovetail joint so that it will be set in the correct position at both ends of the component at installation time is very difficult. Moreover, both of the aforementioned solutions are only used for rectangular joints in which the frame components are at right angles to each other.

SUMMARY OF THE INVENTION

The object of the present invention is to eliminate the drawbacks of prior-art solutions and to achieve a new type of wall frame system in which the marking on each frame component is an identifying code printed on its surface that identifies the frame component in accordance with the construction plan, and in which the notch joint consists of a notch tapering toward its bottom and a main piece fitted into it.

The apparatus of the invention comprises a conveyor for conveying the frame component between different machining stages, a cutting station wherein the wooden parts are cut by machine to predetermined dimensions according to the construction plan, as well as a control unit for controlling the machining operations. Moreover, the apparatus of the invention comprises a computer which can be connected to the control unit and which determines for each frame component an individual code based on the basic data for the building, a printing device, such as an ink jet printer, for printing the code on the surface of the frame component, and a milling apparatus for making the notches tapering towards the bottom as well as the main pieces to be fitted into them.

The system of the invention enables industrial fabrication of diversiform buildings. The building method does not impose any restrictions on architecture. The system of the invention allows easy construction of stepped structures and structures of changing height.

Using the system of the invention, the installation of a wooden framework for a building can be made significantly easier and faster. The markings on the frame components give a detailed definition of the type and properties of the component in question. Moreover, the notches in the component and the notch markings exactly and unambiguously define the position of the component to be joined in a particular notch. The notches, being made in exactly the right positions, add to the rigidity of the wall structure. In addition, the system of the invention allows the making of diagonal joints. As the measurements are defined relative to the centre of the notch, no measurement errors can occur even in the case of diagonal joints.

Moreover, the apparatus of the invention provides a better possibility than prior-art techniques to fabricate the wooden framework of a building from premachined frame components cut to size and provided with the required markings using a single apparatus directly on the building site, thus reducing storage costs and space requirements.

The dimensioning of the wooden frame can be effected e.g. using CAD software to control an automatic machining line that cuts all components and provides them with precise markings and notches so as to make them ready for installation, taking the requirements of frame post spacing, insulation and panelling into account.

BRIEF DESCRIPTION OF THE DRAWINGS

In the following, the invention will be described in detail by the aid of an example by referring to the attached drawings, in which.

DETAILED DESCRIPTION OF THE PREFERRED EMBODIMENT

Figure 1:
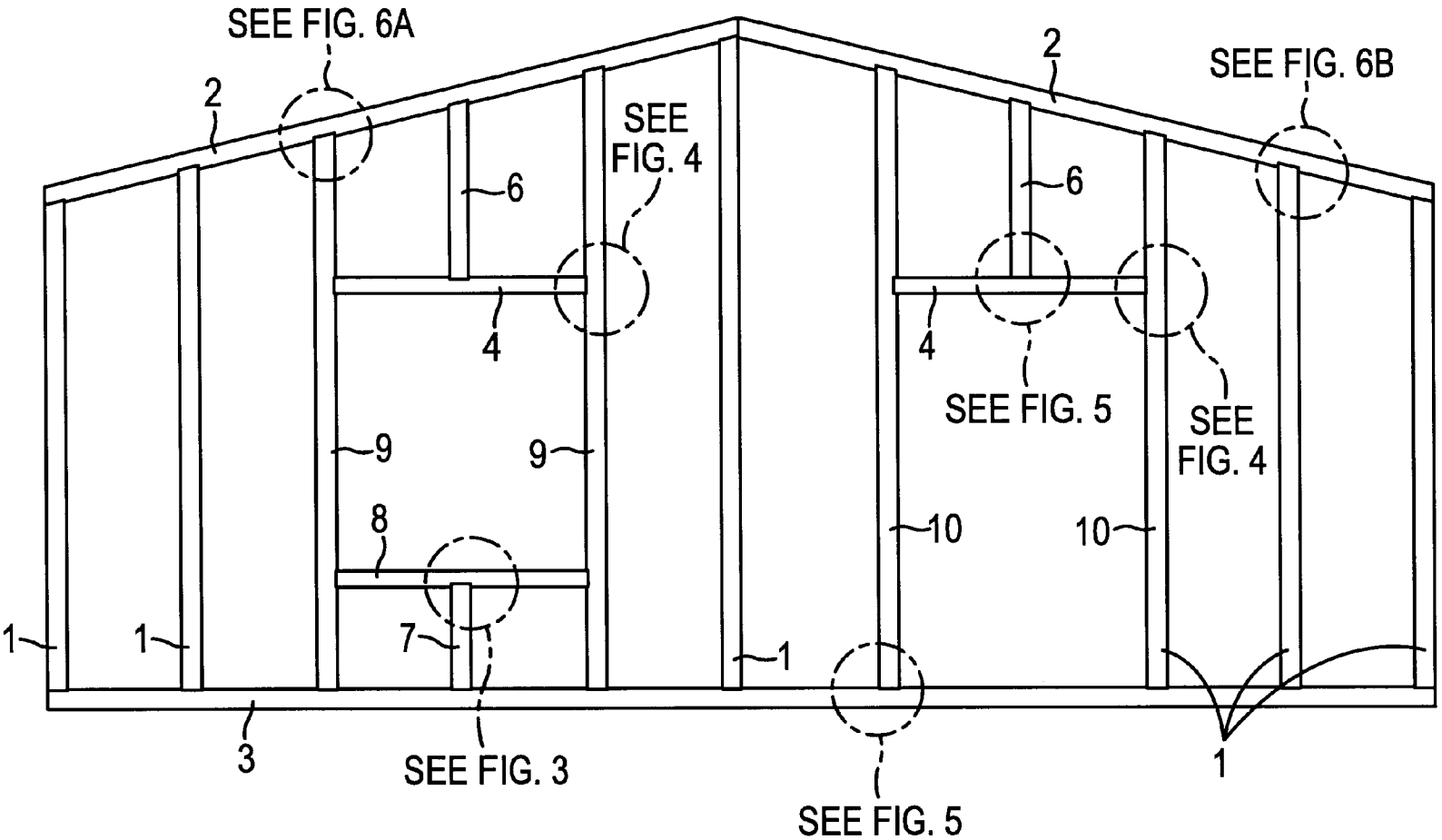
FIG. 1 presents a wall frame of framework construction of changing height according to the invention.

FIG. 1 shows a wall frame of framework construction of variable height according to the invention. The wall frame comprises vertical members 1 of a length that varies according to the height of the wall frame, placed at a distance from each other determined by the required frame post spacing, sloping top stringers 2 and a bottom stringer 3. At the window opening there are vertical members 9, at the door opening vertical members 10, with horizontal members 4 placed above these openings, with further vertical members 6, placed centrally relative to the openings, above the horizontal members 4. Placed below the window opening is yet another vertical member 7.

Figure 2:
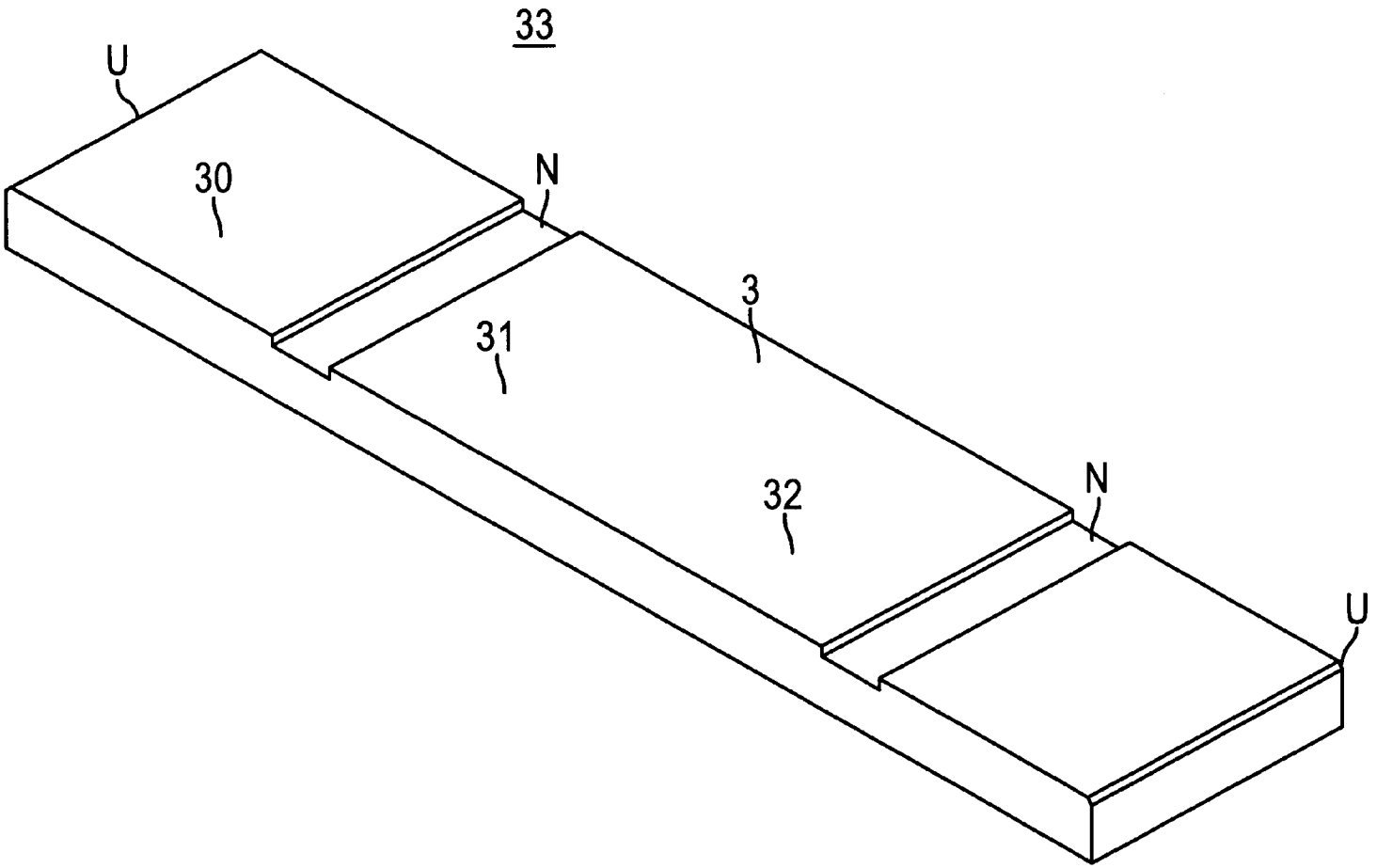
FIG. 2 presents a frame component according to the invention.

In FIG. 2, the frame component 3 (bottom stringer) is provided with two notches N about 5 mm deep extending across the stringer in its widthways direction to allow the connection of other frame components e.g. about the mid portion of the component. The notches have sloping walls, reducing the notch width towards the bottom of the notch. The notches are intended e.g. for the joining of frame components for a window, in which case the distance between them corresponds to the distance between the window frame components. Moreover, the ends of the frame component may be provided with bevellings U tapering towards the end, so the ends of the component will fit into notches provided for joints in other timber components.

The frame component 3 is provided with an identifying code 30 printed on its surface e.g. on the notched side at the end of the timber component, giving the type and dimensions of the component. In FIG. 2, the code S1a/AJ2500 means the horizontal member placed below the window in section a of wall frame S1 (in this case, the wall frame consists of several sections), whose length is 2500 mm. The code may naturally be composed as desired, and it may also contain other information than that proposed above. In addition, the same component can be provided with the marking 31<WINDOW printed beside the window notch N to indicate a window notch (at the first end of the window) and another marking 32 END> at the other window notch N (at the second end of the window). Moreover, the bottom of the notch N may be provided with a code 33 S1a/AT2400 identifying the member to be joined to the notch, thus giving precise information as to which member is to be attached to a particular notch.

Figure 5:
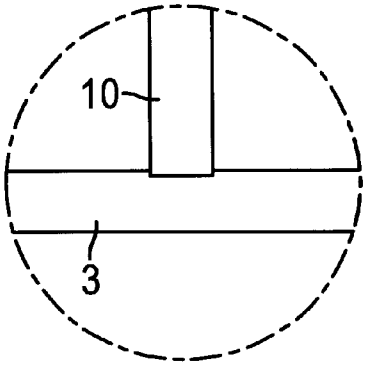
FIGS. 3, 4 5, 6*a* and 6*b* present notch joints according to the invention.
Figure 4:
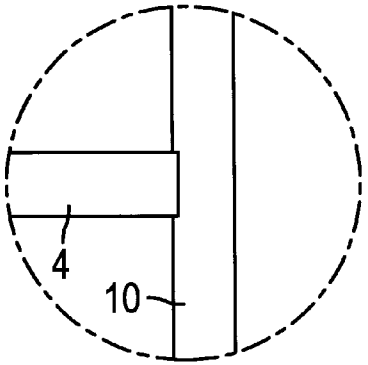
Figure 6B:
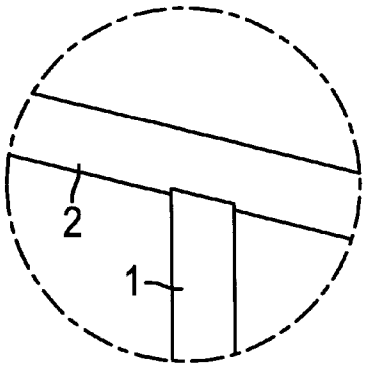
Figure 3:
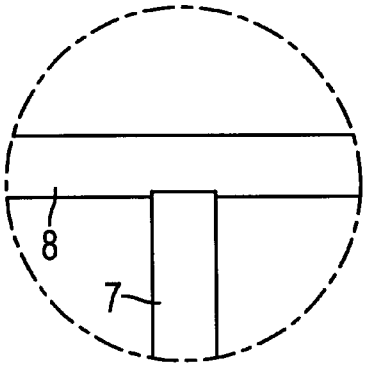
Figure 6A:
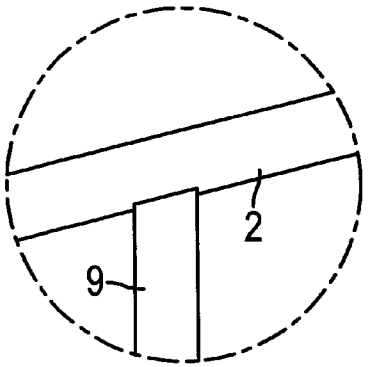

FIGS. 3–5 and 6*b* present different joints LI in magnified view. FIG. 3 shows a rectangular joint DET.1 between the upper end of a vertical member 7 and a horizontal member 8, FIG. 4 shows a joint DET.2 between the right-hand end of a horizontal member 4 and a vertical member 10 and FIG. 5 shows a joint between the bottom stringer 3 and the lower end of a vertical member 10. A skewed joint, in which the members are not at right angles relative to each other, between a vertical member 8 or 1 and a top stringer 2 is presented in FIGS. 6*a* and 6*b*.

Figure 7A:
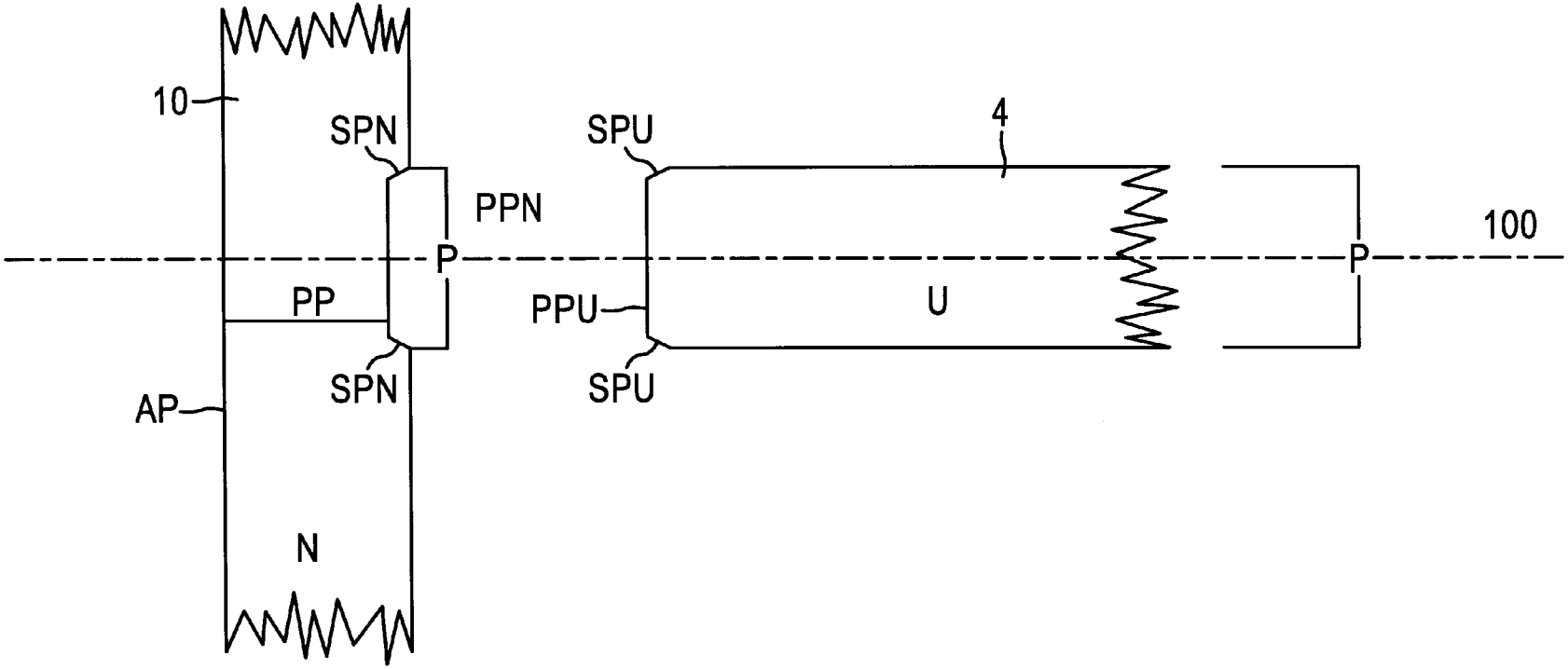
FIG. 7*a* and 7*b* are more detailed illustrations of the notch joint of the invention.
Figure 7B:
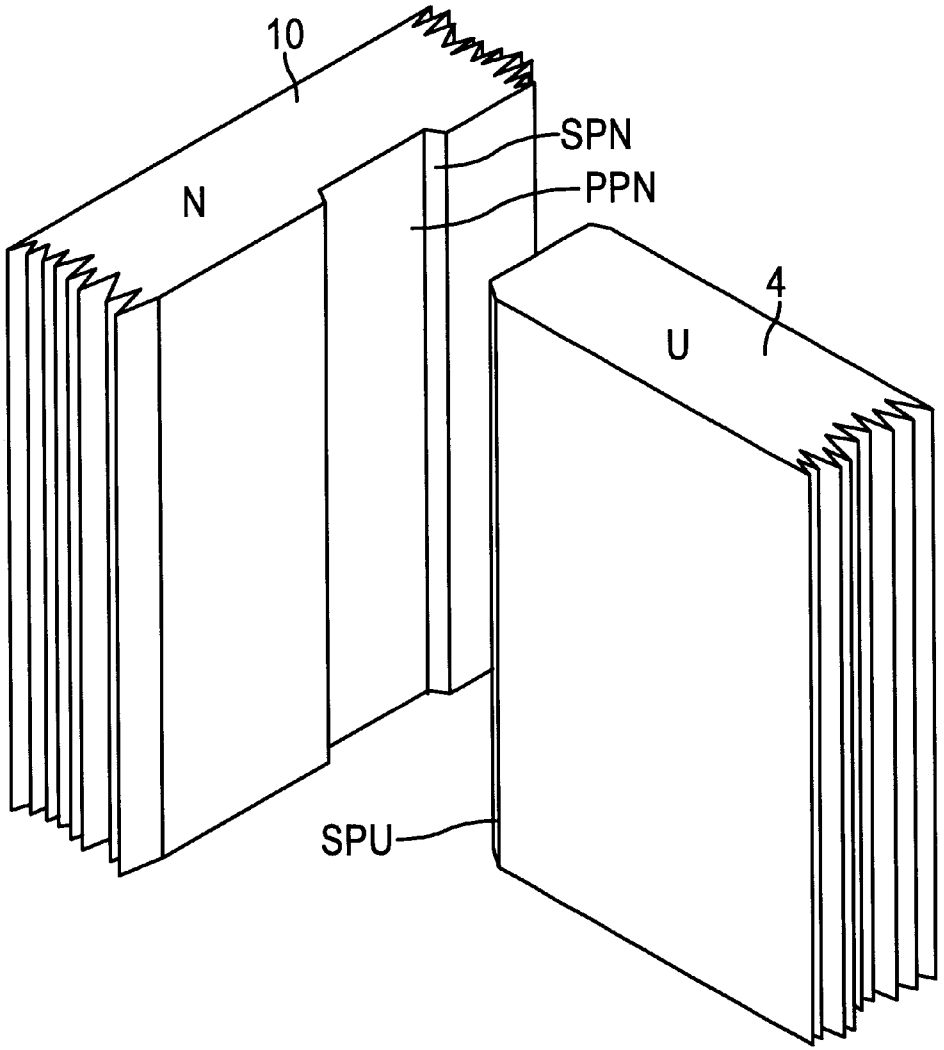
Figure 7C:
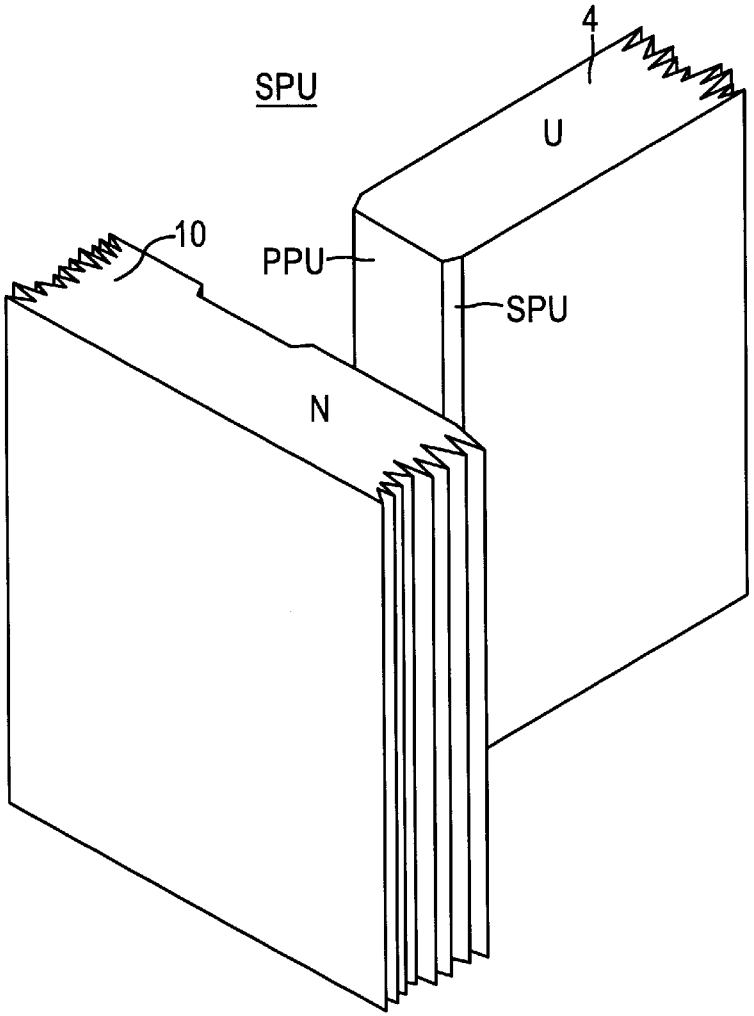

FIGS. 7*a*–7*c* present a more detailed view of an example of a joint between two members 4 and 10, the members being shown separately. The end of frame component 4 has been machined into the shape of a straight letter U, forming the male member of the joint LI. The end face PPU and the splayed side surfaces SPU can be turned relative to the centre axis 100 to form an skewed joint, yet so that the components 4 and 10 are always dimensioned in relation to the centre axis 100 so that the measurements remain unaltered regardless of the joint angle. The bottom surface PPN and splayed side surfaces SPN of the notch joint are machined in locations and at angles defined in the wall construction plan. Thus, the notch N may be either perpendicular to the plane of cross-section of the object or in some other angle.

The surfaces PPU and SPU of the male member U are joined to the surfaces PPN and SPN, respectively, of the female member so that the bottom surface PPU goes against the end surface PPN and the side surfaces SPU go against the side surfaces SPN. The various surfaces of the joint components guide the male members U into the correct location and position in the notches provided for them. The distance PP separating surface PPU of joint component U and surface PPN of the notch N from the rear surface AP of the member 10 remains unchanged regardless of the thickness P of the frame components, so the joint ensures that the wall will preserve its design height regardless of variations in material thickness. The components of the vertical frame are so disposed that the frame component surface AP will be at the end of the wall frame, thus ensuring that the wall frame will preserve its design length regardless of variations in material thickness. In addition, all the frame components can be fastened to each other by using a fixing element and/or fixing agent.

Figure 8:
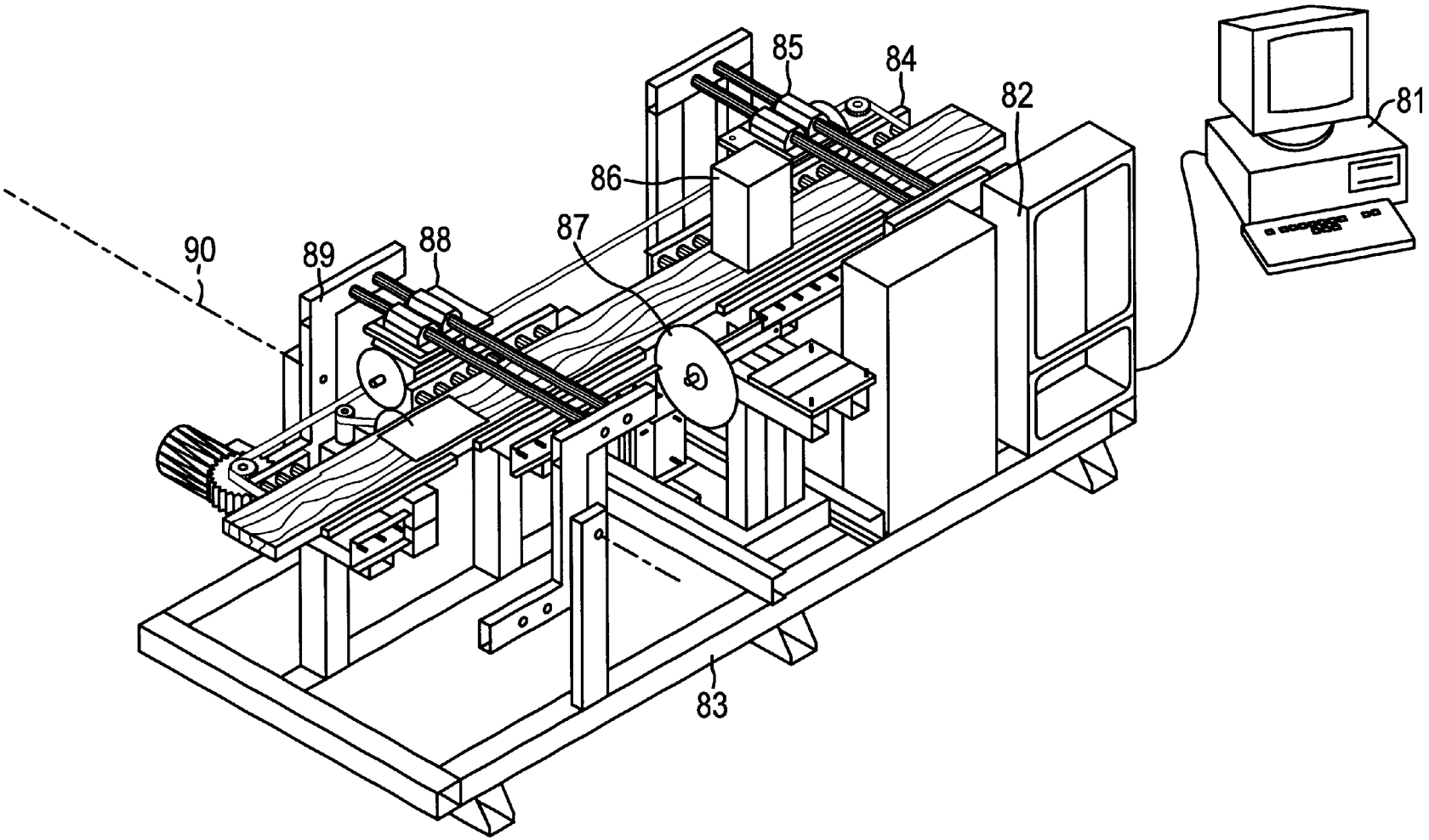
FIG. 8 presents an apparatus according to the invention.

Using an apparatus as presented in FIG. 8, frame components according to the construction drawing for a building with a wooden frame can be produced. The dimensions of the wooden frame are defined on a computer 81 using e.g. CAD software, which defines the measurements of each member as well as the bevellings and notches to be made in each member. Based on these data, the machining line cuts all components and provides them with precise markings, bevellings and notches as necessary so as to make them ready for installation, taking the requirements of frame post spacing, insulation and panelling into account.

For each frame component, the software also determines an identifying code 30 consistent with the installation drawings, each timber component being given a part code defined on the basis of input data. The code specifies the component type, i.e. the nature of the component, the place in the building where the component is to go, and its dimensions.

The code is composed of e.g. four parts, such as S1a/AV 562. The first part S1 indicates the wall frame in the building to which the component belongs, and the letter a following it indicates the section of the wall frame in cases where the wall frame consists of several successive sections. The third part AV defines the component type with a two-letter abbreviation; for instance, frame post TT, top stringer YJ, bottom stringer AJ, horizontal beam AV for an opening, frame post TL with a notch, frame post AL with an aperture and a notch, frame post TA with an aperture. The last part gives the length dimension of the member.

Once each timber component has been assigned a code defining the type and possible notches, the software will output the code data via a cable to the logic control unit 82 of the machine tool section. The logic control unit is also supplied with data specifying the measurements of each component as well as the bevellings and notches to be made in them.

The control unit 82 is mounted on the frame of the machine tool section of the apparatus, said frame consisting of frame beams 82. The timber is conveyed by a roller conveyor 84 through the machine tool section. Also mounted on the frame are the following parts, listed in order starting from the raw material supply end: first milling unit 85, first printer unit 86, second milling unit 87 and cutting/milling unit 88, the operation of which is described below in more detail.

The first milling unit 85 cuts in the frame component, which in the case of a wooden building frame 200 typically is a piece of planed wood material having a width of 200 mm and a thickness of 50 mm, two notches N about 5 mm deep, having bevelled sides and extending widthways across the timber component. The notches are intended for the joining of e.g. window frame components, in which case the distance between them corresponds to the distance between the window frame components.

The printer unit 86 may consist of e.g. an ink jet printer, which prints an alphanumeric identifying code 30 as described above, indicating component type and measurements, on one side of the frame component, at the end of the component, e.g. on the side with the notches. In addition, the same timber component may be provided with markings 31–33.

The second milling unit 87 carries out the milling operations for the larger notches to be made e.g. in the narrow edge of the frame component, such as the notch for a frame beam, to be cut at the end or middle of the frame component. A marking defining such a component is correspondingly made on the surface of the component.

The cutting/milling unit 88, which is provided with a saw blade, cuts the frame component to size. Moreover, it has milling cutters for the cutting of bevellings at the ends of the frame components, so that the ends will fit into notches provided in other components. The whole cutting/milling unit 88 is fitted on a swivelling frame 89 which can be turned about a transverse swing axis 90 to allow cuts to be made for skewed joints. The axis is located at the height of the centre line 100 of the timber component relative to the base 84. Thus, the dimensioning in relation to the centre line 100 of the component remains unchanged regardless of the angular position of the cutting/milling unit 88 and the corresponding obliquity of the joint.

Figure 9A:
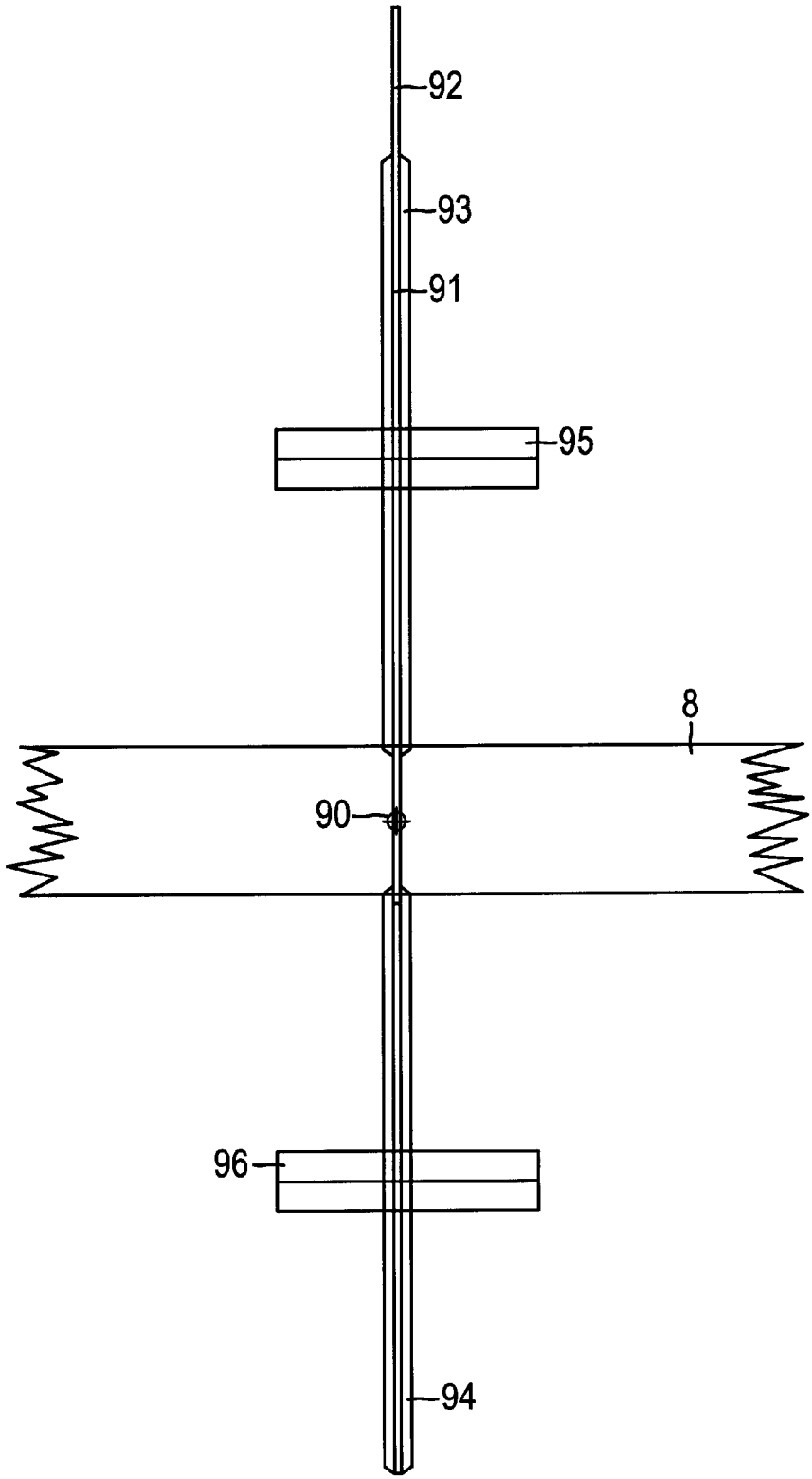
FIGS. 9*a* and 9*b* present a turnable milling unit comprised in the apparatus of the invention, as seen from the direction of the transverse axis and in front view.
Figure 9B:
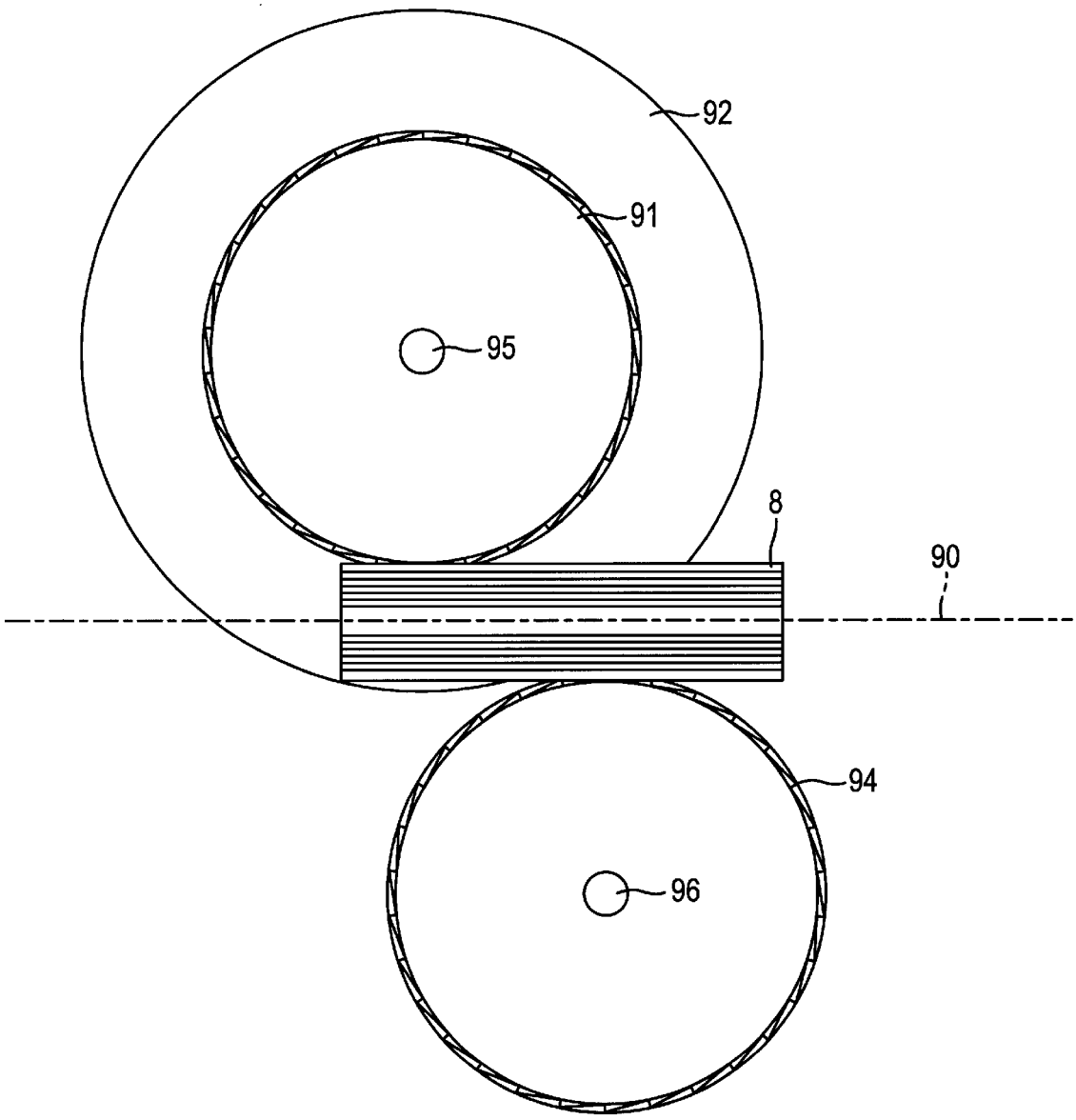
Figure 10:
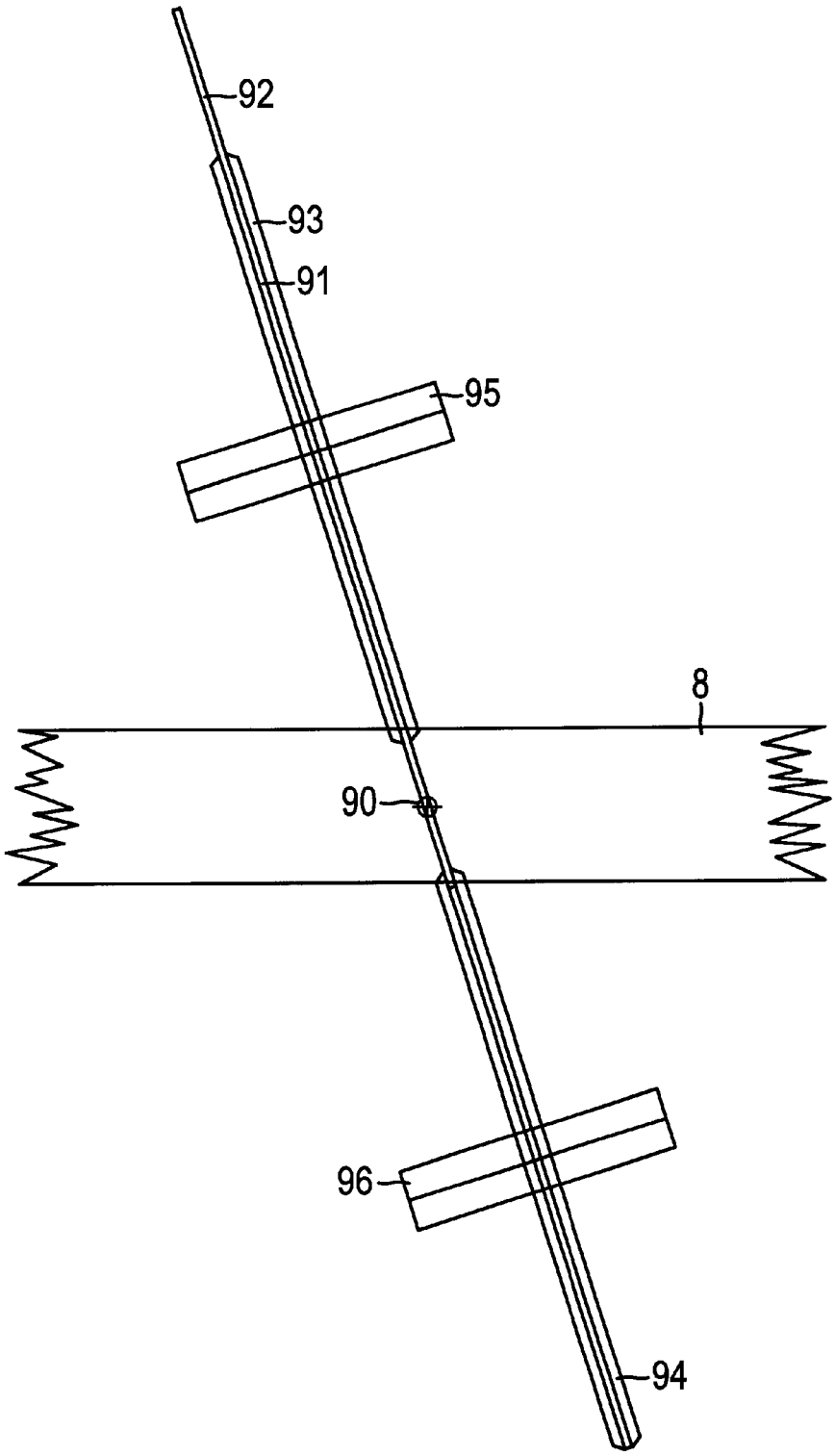
FIG. 10 presents a turnable milling unit comprised in the apparatus of the invention as seen from the direction of the transverse axis and applied to the milling of a diagonal joint.
Figure 11A:
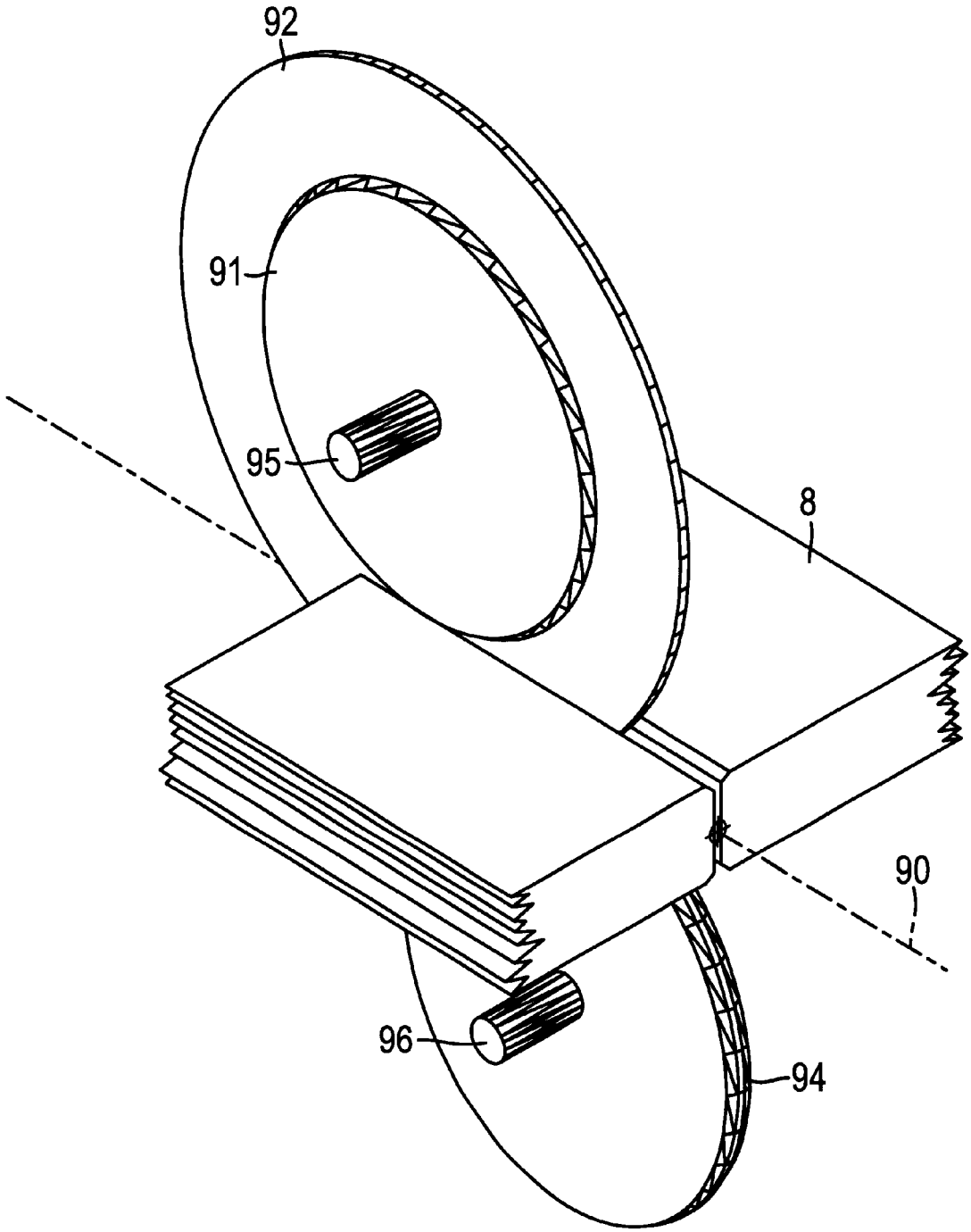
FIGS. 11*a* and 11*b* presents a turnable milling unit comprised in the apparatus of the invention as a projection from the direction of the transverse axis, applied to the milling of a straight joint and a diagonal joint.
Figure 11B:
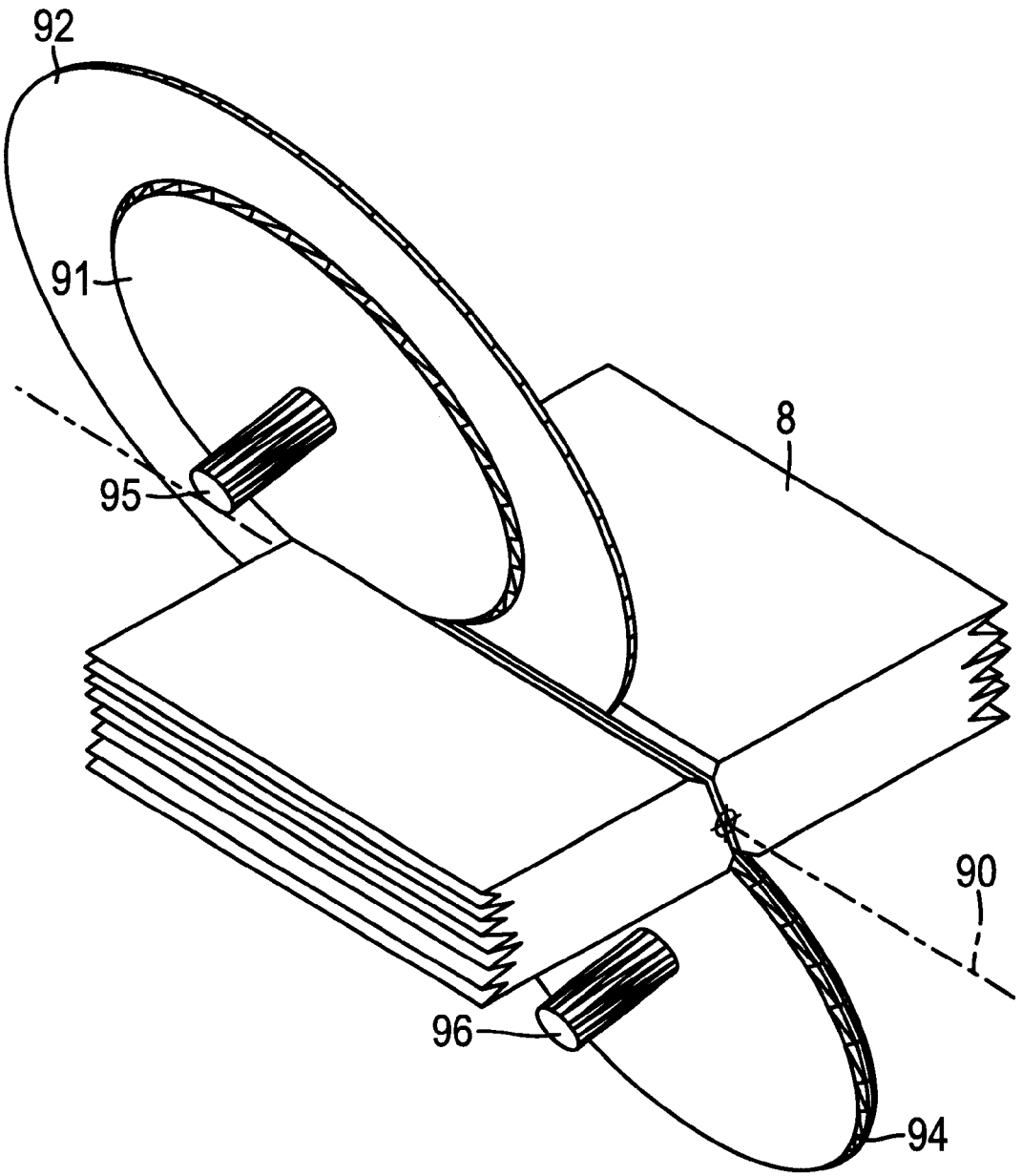

FIGS. 9*a*, 9*b*, 10, 11*a* and 11*b* present more detailed illustrations of the cutting/milling unit 88. On the upper side, the unit comprises a rotating cutter combination 91 having a saw blade 92 in the middle for the cutting of the timber component and milling cutters 93 of a smaller diameter on either side of it for the making of bevellings. On the lower side there is only a milling cutter 94 for the making of bevellings on the opposite side of the frame components (FIGS. 9*a*, 11*a*). The upper combination 91 and the lower cutter 94 rotate on axles 95, 96. FIG. 9*b* presents the cutter assemblies in front view. It shows that they are not exactly aligned one over the other, but their drive shafts 95 and 96 have a small distance between them in the sideways direction. With this arrangement, the saw blade 92 can cut deep enough to sever the timber component without touching the lower milling cutter 94. In the case of a skewed joint, the cutting/milling unit 88 is turned with respect to the axis 90, in which case the saw blade will cut in an oblique direction as shown in FIG. 10, 11*b*, and the bevellings are made in accordance with this oblique cut because the whole unit 88 turns through the same angle about the same axis. Such a unit 88, which has milling cutters on either side of a saw blade for the milling of the bevellings, makes it possible to produce several frame components from the same piece of wood because bevellings are made at each sawing end of the component in conjunction with the cutting.

It is obvious to the person skilled in the art that different embodiments of the invention are not restricted to the examples presented above, but that they may be varied within the claims presented below.

What is claimed is:

1. Wooden wall frame system of framework construction for a building, said wall frame consisting of top and bottom stringers, vertical frame components fitted between them and frame components designed especially for openings, in which the frame components of the wall frame arc joined to each other via splayed notch joints and in which each frame component is provided with markings to facilitate installation, wherein an identifying code is defined for each frame component, said code identifying the frame component in accordance with the construction plan and comprising at least the location of the frame component in the building, and that the identifying code is printed on the surface of the frame component, and the notch joint consists of a splayed (SPN) notch (N) tapering toward its bottom and having a depth of 1–10 mm, and a main piece (U) fitted into it, said main piece tapering towards the end and having edges (SPU) that substantially correspond to the shape of the edges of the notch.

2. Wall frame as defined in claim 1, wherein the identifying code also comprises at least the type of the frame component, the wall frame component in the wall frame or a measurement of the frame component.

3. Wall frame as defined in claim 1, wherein the notch joint is an oblique joint and that the dimensioning of the notch joint is effected in relation to the center line of the joint so that the dimensioning will remain substantially unchanged regardless of the joint angle.

4. Wall frame as defined in claim 1, wherein the frame component bears additional markings printed on it, containing instructions relating to the installation of the wall frame.

5. Wall frame as defined in claim 1, wherein said frame component bears the identifying code of the other frame component to be joined to it, this code being printed on the notch surface or at least in its immediate vicinity.

6. Apparatus for the fabrication of a frame component for a wooden wall frame of framework construction consisting of top and bottom stringers, vertical frame components fitted between them and frame components designed especially for openings, in which the frame components of the wall frame are joined to each other via notch joints and in which each frame component is provided with markings to facilitate installation, said apparatus comprising a computer system used for the dimensioning of the frame component as well as milling assembly provided with a logic control unit for the machining of the frame component, said logic control unit receiving the data for the machining of the frame component from said computer system, in which the milling line comprises a frame, a conveyor for conveying the frame component between different machining stages, and milling and cutting units for the milling and cutting of the frame component, wherein the computer determines for each frame component an identifying code identifying the frame component in accordance with the construction plan and comprising at least the type of the frame component, that the apparatus comprises a printing unit for printing the identifying code on the surface of the frame component, and the milling units produce a notch joint consisting of a splayed (SPN) notch (N) tapering toward its bottom and having a depth of 1–10 mm, and a main piece (U) fitted into it, said main piece tapering toward its end and having edges (SPU) that substantially correspond to the shape of the edges of the notch.

7. Apparatus as defined in claim 6, further comprising a milling unit fitted in conjunction with a cutting unit to allow a bevelling to be made at the end of the timber component, and that the unit has been fitted to the frame in a manner allowing it to be turned about a transverse axis located at the height of the center line of the timber component so that the dimensioning of the notch joint is effected substantially in relation to the center line of the joint so that the dimensioning will remain substantially unchanged regardless of the joint angle.

8. Apparatus as defined in claim 7, wherein the turnable cutting unit and the milling unit fitted in conjunction with it consist of a rotating saw blade fitted on a drive shaft and rotating milling, cutters fitted on a drive shaft.

9. Apparatus as defined in claim 8, further comprising milling cutters fitted on either side of the saw blade to allow bevellings to be made on one side of two frame components.

10. Apparatus as defined in claim 8, further comprising milling cutters fitted on the opposite side of the saw blade, to allow bevellings to be made on the opposite side of two frame components.

* * * * *